US011049631B2

(12) United States Patent
Kim et al.

(10) Patent No.: US 11,049,631 B2
(45) Date of Patent: Jun. 29, 2021

(54) POWER CABLE

(71) Applicant: LS CABLE & SYSTEM LTD., Anyang-si (KR)

(72) Inventors: Ji Sung Kim, Suwon-si (KR); Weon Bae Kim, Gangneung-si (KR); Kyoung Ro Ko, Daegu (KR); Joon Keun Lee, Seoul (KR); Kum Hwan Cha, Anyang-si (KR); Jae Cheol Gwag, Daegu (KR); Tae Hyun Kim, Seoul (KR)

(73) Assignee: LS CABLE & SYSTEM LTD., Anyang-si (KR)

( * ) Notice: Subject to any disclaimer, the term of this patent is extended or adjusted under 35 U.S.C. 154(b) by 0 days.

(21) Appl. No.: 16/486,048

(22) PCT Filed: Mar. 30, 2017

(86) PCT No.: PCT/KR2017/003507
§ 371 (c)(1),
(2) Date: Aug. 14, 2019

(87) PCT Pub. No.: WO2018/151371
PCT Pub. Date: Aug. 23, 2018

(65) Prior Publication Data

US 2020/0051713 A1 Feb. 13, 2020

(30) Foreign Application Priority Data

Feb. 16, 2017 (KR) ..... 10-2017-0020986

(51) Int. Cl.
*H01B 9/02* (2006.01)
*H01B 1/02* (2006.01)
(Continued)

(52) U.S. Cl.
CPC ..... *H01B 9/027* (2013.01); *H01B 1/02* (2013.01); *H01B 3/20* (2013.01); *H01B 3/30* (2013.01);
(Continued)

(58) Field of Classification Search
None
See application file for complete search history.

(56) References Cited

U.S. PATENT DOCUMENTS 2,709,197 A * 5/1955 Davey ..... H01B 7/0241 174/25 R
3,513,297 A * 5/1970 John ..... H05B 3/342 219/545
(Continued)

FOREIGN PATENT DOCUMENTS

CN 203422971 * 2/2014 ..... H01B 7/08
JP H03171513 A 7/1991
(Continued)

OTHER PUBLICATIONS

Kim. KR1020160121873_English_Translation. KIPO. (Year: 2016).*
(Continued)

*Primary Examiner* — Timothy J. Dole
*Assistant Examiner* — Muhammed Azam
(74) *Attorney, Agent, or Firm* — K&L Gates LLP

(57) ABSTRACT

A power cable includes a conductor, an inner semi-conductive layer covering the conductor, an insulating layer covering the inner semi-conductive layer and impregnated with insulating oil, an outer semi-conductive layer covering the insulating layer, a metal sheath layer covering the outer semi-conductive layer, and a cable protection layer covering the metal sheath layer. A minimum thickness t1 of a certain cross section of the metal sheath layer is less than or equal to 90% of a maximum thickness t2 thereof.

11 Claims, 3 Drawing Sheets

(51) Int. Cl.

| | |
|---|---|
| ***H01B 3/20*** | (2006.01) |
| ***H01B 3/30*** | (2006.01) |
| ***H01B 7/14*** | (2006.01) |
| ***H01B 7/17*** | (2006.01) |
| ***H01B 9/00*** | (2006.01) |
| ***H01B 17/34*** | (2006.01) |

(52) U.S. Cl.
CPC ..... *H01B 7/14* (2013.01); *H01B 7/17* (2013.01); *H01B 9/006* (2013.01); *H01B 17/34* (2013.01)

(56) References Cited

U.S. PATENT DOCUMENTS 3,608,710 A * 9/1971 Pugh ..... H01B 17/34 405/154.1
3,651,244 A * 3/1972 Silver ..... H01B 9/022 174/36
3,749,812 A * 7/1973 Reynolds ..... H01B 9/0611 174/25 R
3,775,549 A * 11/1973 Matsuda ..... B32B 7/12 174/25 R
3,798,345 A * 3/1974 Priaroggia ..... H01B 9/0616 174/14 R
3,813,477 A * 5/1974 Fischer ..... H02G 9/02 174/70 R
3,962,529 A * 6/1976 Kubo ..... H01B 7/29 174/15.6
4,039,740 A * 8/1977 Iwata ..... H01B 12/02 174/15.5
4,225,747 A * 9/1980 Vecellio ..... H01B 3/22 174/25 C
4,237,334 A * 12/1980 Kojima ..... B32B 27/10 174/25 R
4,329,536 A * 5/1982 Sato ..... H01B 3/22 174/25 C
4,417,093 A * 11/1983 Occhini ..... H01B 3/20 174/102 SC
4,602,121 A * 7/1986 Priaroggia ..... H01B 7/14 174/25 R
4,782,194 A * 11/1988 Johnsen ..... H01B 7/226 174/106 R
4,853,490 A * 8/1989 Bosisio ..... H01B 9/0611 174/25 R
5,481,070 A * 1/1996 Hirose ..... H01B 9/0611 174/120 FP
5,521,010 A * 5/1996 Tanaka ..... C08F 110/02 174/110 PM
5,715,343 A * 2/1998 Anelli ..... G02B 6/4492 385/100
5,889,087 A * 3/1999 Hayashi ..... H01B 3/441 523/173
6,201,191 B1 * 3/2001 Yorita ..... H01B 9/0688 174/110 R
6,383,634 B1 * 5/2002 Kornfeldt ..... H01B 3/20 428/379
9,853,438 B2 * 12/2017 Chae ..... H01B 9/027
10,128,026 B2 * 11/2018 Na ..... H01B 1/02
2001/0042635 A1 * 11/2001 Kondo ..... H01B 7/14 174/11 OR
2002/0127401 A1 * 9/2002 Perego ..... C08F 255/02 428/375
2004/0029013 A1 * 2/2004 Perego ..... H01B 3/441 429/233
2004/0091707 A1 * 5/2004 Perego ..... C08F 218/12 428/375
2010/0186988 A1 * 7/2010 Jeroense ..... H01B 7/045 174/103
2010/0206616 A1 * 8/2010 Motoi ..... H01B 13/08 174/25 R
2012/0024565 A1 * 2/2012 Orini ..... H01B 7/14 174/106 R
2012/0285725 A1 * 11/2012 Maritano ..... H01B 3/52 174/120 FP
2017/0012371 A1 * 1/2017 Chae ..... H01R 4/68
2017/0222422 A1 * 8/2017 Chae ..... H02G 15/064
2018/0025810 A1 * 1/2018 Ko ..... H01B 3/48 174/105 R
2019/0057794 A1 * 2/2019 Jung ..... H02G 9/02
2020/0013526 A1 * 1/2020 Kim ..... H01B 9/02

FOREIGN PATENT DOCUMENTS

| | | | |
|---|---|---|---|
| JP | H08161944 | A | 6/1996 |
| JP | H1021762 | A | 1/1998 |
| JP | H10208550 | A | 8/1998 |
| JP | 2001084848 | A | 3/2001 |
| JP | 2006114342 | A | 4/2006 |
| KR | 20160101643 | A | 8/2016 |
| KR | 20160121873 | A | 10/2016 |
| WO | 2007119655 | A1 | 10/2007 |
| WO | 2016133332 | A1 | 8/2016 |

OTHER PUBLICATIONS

Ko. KR1020150101643_English_Translation. KIPO (Year: 2016).*
Shen. CN203422971_English_Translation (Year: 2014).*
International Search Report for related International Application No. PCT/KR2017/003507; report dated Aug. 23, 2018; (3 pages).
Written Opinion for related International Application No. PCT/KR2017/003507; report dated Aug. 23, 2018; (5 pages).
Supplementary European Search Report for related European Application No. 17896800.4; action dated Oct. 23, 2020; (8 pages).

* cited by examiner

POWER CABLE

CROSS-REFERENCE TO RELATED APPLICATIONS

The present application is a National Stage of International Application No. PCT/KR2017/003507, filed Mar. 30, 2017, which claims priority to Korean Application No. 10-2017-0020986, filed Feb. 16, 2017, the disclosure of which are incorporated herein by reference.

TECHNICAL FIELD

The present invention relates to a power cable, particularly, an ultra-high voltage underground or submarine cable for long-distance direct-current transmission. More specifically, the present invention relates to a power cable, in which an insulating layer has high dielectric strength, an electric field applied to the insulating layer is effectively reduced, and particularly, a void is suppressed from occurring in the insulating layer due to contraction of insulating oil, caused by a decrease of temperature in the insulating layer under a low-temperature condition or when the supply of an electric current is stopped, thereby effectively suppressing partial discharge, dielectric breakdown, etc. due to an electric field concentrated in the void.

BACKGROUND

Power cables employing a polymeric insulator, such as cross-linked polyethylene (XLPE), as an insulating layer have been used. However, due to space charges formed at a high direct-current (DC) electric field, paper-insulated cables having an insulating layer formed by impregnating insulating paper, which is cross-wound to cover a conductor, etc., with insulating oil have been used as ultra-high voltage DC transmission cables.

Examples of the paper-insulated cables include an oil-filled (OF) cable in which low-viscosity insulating oil is circulated, a mass-impregnated non-draining (MIND) cable impregnated with high or medium viscosity insulating oil, and the like. The OF cable is limited in terms of a transmission rate of a hydraulic pressure for circulation of the insulating oil and thus is not suitable as a long-distance transmission cable. Particularly, the OF cable is not suitable as a submarine cable because it is difficult to install insulating-oil circulation facility at the seabed.

Accordingly, the MIND cable is generally used as a long-distance DC transmission cable or an ultra-high voltage submarine cable.

In the MIND cable, an insulating layer is formed by winding insulating paper in a plurality of layers. For example, either kraft paper or semi-synthetic paper formed by stacking kraft paper and thermoplastic resin such as polypropylene resin may be used as the insulating paper.

In the case of a cable in which only kraft paper is wound and impregnated with insulating oil, when the cable is operated (when an electric current is supplied to the cable), a temperature change occurs inwardly in a radial direction, i.e., outwardly from a portion of the insulating layer adjacent to an inner semi-conductive layer, i.e., toward an outer semi-conductive layer outside the insulating layer, due to heat generated due to a joule loss, caused by the electric current flowing through a conductor of the cable.

Accordingly, the viscosity of the insulating oil in the portion of the insulating layer adjacent to the inner semi-conductive layer having relatively high temperature decreases and thus the insulating oil thermally expands and moves to a portion of the insulating layer adjacent to the outer semi-conductive layer. In contrast, when the temperature decreases, the viscosity of the moving insulating oil increases but does not return to the original position. Thus, deoiling voids may occur inwardly in a radial direction, i.e., in the portion of the insulating layer adjacent to the inner semi-conductive layer, due to thermal contraction the insulating oil.

In addition, when the cable is operated (when an electric current is supplied to the cable), the viscosity of the impregnated insulating oil decreases due to heat generated due to joule loss caused by the electric current flowing through the conductor of the cable and thus the insulating oil thermally expands and moves from a portion of the cable installed at a higher position to a portion of the cable installed at a lower position. When the temperature decreases, the viscosity of the moving insulating oil increases but does not return to the original position and thus deoiling voids may occur due to the thermal contraction of the insulating oil.

Because there is no insulating oil in the deoiling voids, an electric field may be concentrated in the deoiling void and thus partial discharge, dielectric breakdown, or the like may occur starting from the deoiling voids, thereby decreasing the lifespan of the cable.

However, when the insulating layer is formed using semi-synthetic paper, the insulating oil may be suppressed from flowing due to the thermal expansion of thermoplastic resin, such as polypropylene resin, which is not impregnated with the insulating oil during the operation of the cable. In addition, because an insulation resistance of polypropylene resin is higher than that of kraft paper, a voltage shared by polypropylene may be decreased even when deoiling voids occur.

Because the insulating oil does not move within polypropylene resin, the flow of the insulating oil in a diameter direction of the cable may be suppressed due to gravity. Furthermore, surface pressure is applied to the kraft paper due to thermal expansion of polypropylene resin at an impregnation temperature during the manufacture of the cable or at an operating temperature during the operation of the cable and thus the flow of the insulating oil may be further suppressed.

However, even when deoiling voids are suppressed from occurring due to the flow of the insulating oil, the insulating oil impregnated in the insulating layer, the semi-conductive layers, etc. contracts and thus a plurality of deoiling voids may occur in the insulating layer and the like, when the MIND cable is installed in a low-temperature environment to be used as an underground cable or a submarine cable in an extreme region. Thus, problems, such as partial discharge, dielectric breakdown, etc., may occur due to concentration of an electric field in the deoiling voids, until the deoiling voids are removed due to the expansion of the contracting insulating oil due to an increase in temperature of the insulating layer and the like by heat generated in the conductor during the operation of the cable.

Therefore, there is an urgent need for a power cable, in which an insulating layer has high dielectric strength, an electric field applied to the insulating layer may be effectively alleviated, and deoiling voids may be suppressed from occurring in the insulating layer particularly in a low-temperature environment to effectively suppress partial discharge, dielectric breakdown, and the like due to concentration of an electric field in the deoiling voids.

DETAILED DESCRIPTION OF THE INVENTION

Technical Problem

The present invention is directed to providing an ultra-high voltage power cable, in which an insulating layer has high dielectric strength and an electric field applied to the insulating layer may be effectively reduced to increase the lifespan of the cable.

The present invention is also directed to providing an ultra-high voltage direct-current (DC) power cable, in which deoiling voids may be suppressed from occurring in an insulating layer in an insulator in a low-temperature environment or when the supply of an electric current is stopped and thus partial discharge, dielectric breakdown, and the like may be effectively suppressed due to the concentration of an electric field in the deoiling voids.

Technical Solution

According to an aspect of the present invention, a power cable may include a conductor, an inner semi-conductive layer covering the conductor, an insulating layer covering the inner semi-conductive layer and impregnated with insulating oil, an outer semi-conductive layer covering the insulating layer, a metal sheath layer covering the outer semi-conductive layer, and a cable protection layer covering the metal sheath layer. A minimum thickness t1 of a certain cross section of the metal sheath layer may be less than or equal to 90% of a maximum thickness t2 thereof.

In an embodiment, the minimum thickness t1 of the cross section of the metal sheath layer may be in a range of 50 to 90% of the maximum thickness t2.

In an embodiment, an outer side of the metal sheath layer may be generally oval in shape, opposite and symmetrical upper and lower portions of the cross section thereof may have the minimum thickness t1, and opposite and symmetrical left and right portions of the cross section may have the maximum thickness t2.

In an embodiment, the metal sheath layer may comprise a lead sheath formed of pure lead or a lead alloy.

In an embodiment, the insulating layer may comprise an inner insulating layer, an intermediate insulating layer, and an outer insulating layer. The inner insulating layer and the outer insulating layer may be each formed of kraft paper impregnated with insulating oil, and the intermediate insulating layer may be formed of semi-synthetic paper impregnated with the insulating oil. The semi-synthetic paper may comprise a plastic film and kraft paper stacked on at least one surface of the plastic film, a thickness of the inner insulating layer may be in a range of 1 to 10%, a thickness of the intermediate insulating layer may be 75% or more, and a thickness of the outer insulating layer may be in a range of 5 to 15%, based on a total thickness of the insulating layer. Resistivities of the inner insulating layer and the outer insulating layer may be less than resistivity of the intermediate insulating layer.

In an embodiment, the thickness of the outer insulating layer may be greater than the thickness of the inner insulating layer.

In an embodiment, the thickness of the outer insulating layer may be 1 to 30 times the thickness of the inner insulating layer.

In an embodiment, the insulating oil may comprise a high-viscosity insulating oil having a kinematic viscosity of 500 centistokes (Cst) or more at 60° C.

In an embodiment, the insulating oil may be a medium-viscosity insulating oil having a kinematic viscosity of 5 to 500 centistokes (Cst) at 60° C.

In an embodiment, the cable protective layer may comprise an inner sheath, a bedding layer, a metal reinforcement layer, and an outer sheath.

In an embodiment, the cable protection layer may comprise a bedding layer, a metal reinforcement layer, a bedding layer, and an outer sheath which are stacked sequentially on an outer side of the metal sheath layer.

In an embodiment, the cable protective layer may further comprise a wire sheath and an outer sheath layer.

Advantageous Effects

In a power cable of the present invention, dielectric strength can be improved due to an insulating layer and semi-conductive layers having specific configurations, and an electric field applied to the insulating layer can be effectively reduced to obtain an effect of increasing the lifespan of the cable.

In addition, in the power cable of the present invention, a metal sheath layer can be easily deformed by external pressure by locally differently adjusting a thickness thereof, so that deoiling voids occurring in an insulating layer and the like included in the metal sheath layer may be reduced to effectively suppress partial discharge, dielectric breakdown, etc. due to the concentration of an electric field in the deoiling voids.

MODE OF THE INVENTION

Hereinafter, exemplary embodiments of the present invention will be described in detail. The present invention is, however, not limited thereto and may be embodied in many different forms. Rather, the embodiments set forth herein are provided so that this disclosure will be thorough and complete, and fully convey the scope of the invention to those skilled in the art. Throughout the specification, the same reference numbers represent the same elements.

Figure 1:
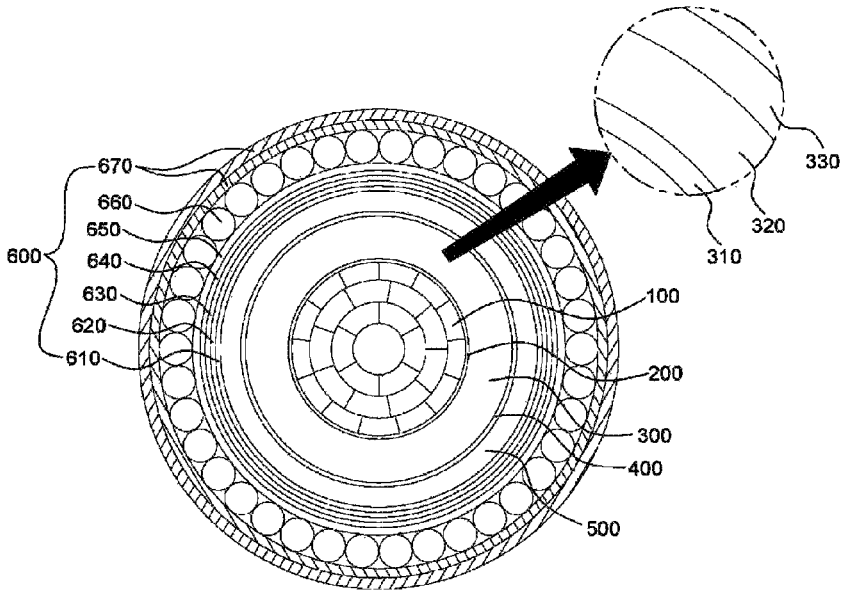
FIG. 1 is a schematic view of a cross section of a power cable according to an embodiment of the present invention.
Figure 2:
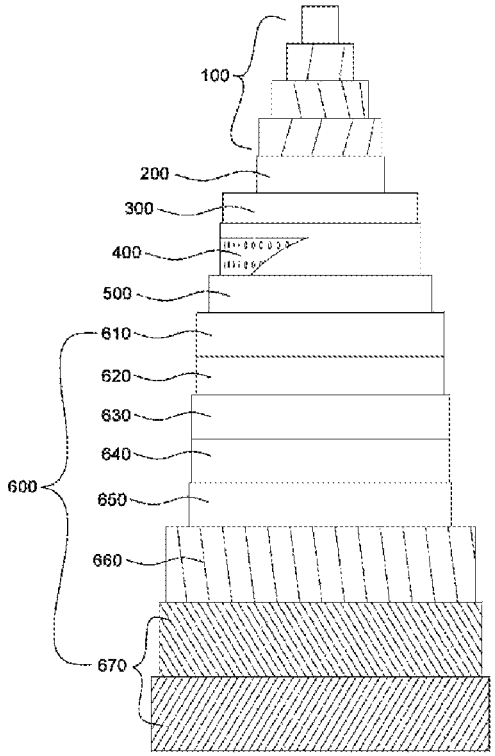
FIG. 2 is a schematic view of a longitudinal section of the power cable of FIG. 1.

FIGS. 1 and 2 are diagrams schematically illustrating a cross section and a longitudinal section of a power cable according to an embodiment of the present invention.

As illustrated in FIGS. 1 and 2, the power cable according to the present invention may include a conductor 100, an inner semi-conductive layer 200 covering the conductor 100, an insulating layer 300 covering the inner semi-conductive layer 200, an outer semi-conductive layer 400 covering the insulating layer 300, a metal sheath layer 500 covering the outer semi-conductive layer 400, a cable protection layer 600 covering the metal sheath layer 500, and the like.

The conductor 100 may serve as a current moving path for transmission of current, and may be formed of high-purity copper (Cu), aluminum (Al), or the like having high conductivity to minimize power loss and having appropriate strength and flexibility to be used as a conductor of the power cable, and particularly, annealed copper wire having high elongation and conductivity. A cross-sectional area of the conductor 100 may vary according to a power transmission rate, usage, etc. of the power cable.

Preferably, the conductor 100 may include a flat conductor formed by stacking flat wires in a plurality of layers on a circular center wire or a circularly compressed conductor formed by stacking round wires in a plurality of layers on a circular center wire and compressing the round wires. The conductor 100 including a flat conductor formed by a so-called keystone method is economical, because an outer diameter of the cable may be reduced due to a high space factor of the conductor 100 and the cross-sectional area of each wire of the conductor 100 may be increased to reduce the total number of wires. In addition, the conductor 100 is effective because there is less voids therein and the weight of the insulating oil to be contained in the conductor 100 may be reduced.

The inner semi-conductive layer 200 may suppress distortion and concentration of an electric field due to an irregular surface of the conductor 100 to suppress partial discharge, dielectric breakdown, or the like from occurring due to the concentration of an electric field at an interface between the inner semi-conductive layer 200 and the insulating layer 300 or due to the concentration of an electric field in the insulating layer 300.

The inner semi-conductive layer 200 may be formed by cross-winding semi-conductive paper, e.g., carbon paper obtained by applying a conductive material such as carbon black onto insulating paper or a film formed of a polymer composite material in which a conductive material such as carbon black is dispersed. The inner semi-conductive layer 200 may have a thickness of about 0.2 to 3.0 mm.

The insulating layer 300 is formed by winding insulating paper in a plurality of layers. For example, either kraft paper or semi-synthetic paper formed by stacking kraft paper and thermoplastic resin such as polypropylene resin may be used as the insulating paper.

In an exemplary embodiment of the present invention, the insulating layer 300 may include an inner insulating layer 310, an intermediate insulating layer 320, and an outer insulating layer 330. The inner insulating layer 310 and the outer insulating layer 330 may be formed of a material having lower resistivity than that of a material of the intermediate insulating layer 320. Thus, each of the inner insulating layer 310 and the outer insulating layer 330 may reduce an electric field by preventing a high electric field, which is applied to the cable when the cable is operated, from being applied directly onto the conductor 100 or directly below the metal sheath layer 500, and may suppress deterioration of the intermediate insulating layer 320.

Figure 3:
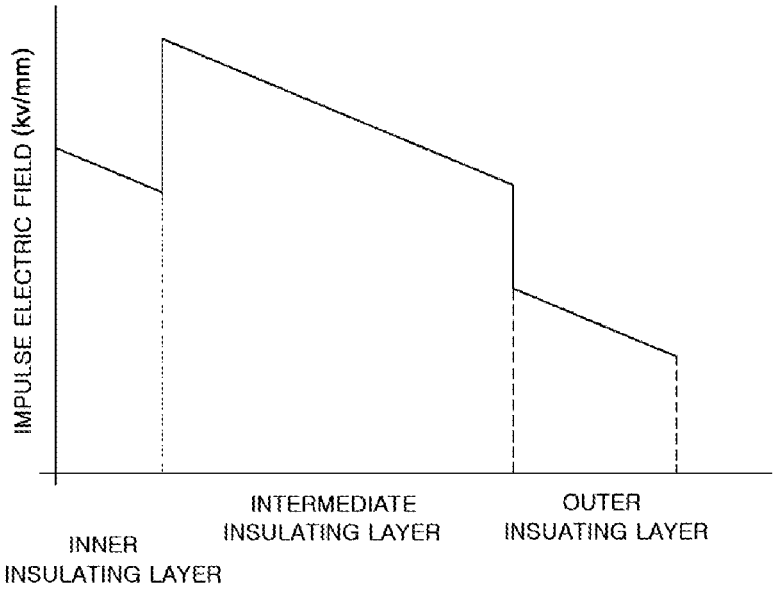
FIG. 3 is a graph schematically showing a process of reducing an electric field in an insulating layer of a power cable according to the present invention.

FIG. 3 is a graph schematically showing a process of reducing an electric field in an insulating layer of a power cable according to the present invention. As illustrated in FIG. 3. a high electric field, which is generally generated in a DC cable, may be effectively suppressed from being applied directly onto the conductor 100 and directly below the metal sheath layer 500 by reducing a DC electric field in the inner insulating layer 310 and the outer insulating layer 330 having relatively low resistivity. In the case of an impulse, a maximum impulse electric field applied to the intermediate insulating layer 320 is controlled to be equal to or less than 100 kV/mm and a high impulse electric field applied to the inner insulating layer 310 may be reduced to suppress deterioration of the inner insulating layer 310. Thus, deterioration of the intermediate insulating layer 320 may be also suppressed. Here, the impulse electric field refers to an electric field applied to the cable when an impulse voltage is applied to the cable.

Therefore, as illustrated in FIG. 3, a maximum impulse electric field value of the inner insulating layer 310 is designed to be less than that of the intermediate insulating layer 320, so that a high electric field may not be applied directly onto the conductor 100 or directly below the metal sheath layer 500. A maximum impulse electric field applied to the intermediate insulating layer 320 is equal to an internal electric field of the intermediate insulating layer 320. The internal electric field may be controlled to be equal to or less than an allowable impulse electric field, e.g., 100 kV/mm, of the intermediate insulating layer 320, thereby suppressing deterioration of the insulating layer 320.

Accordingly, the entire insulating layer 300 may be made compact by suppressing a high electric field from being applied to the inner insulating layer 310 and the outer insulating layer 330, and particularly, to a cable connection member vulnerable to an electric field, and further maximizing the performance of the intermediate insulating layer 320. The deterioration of the insulating layer 300 may be suppressed to prevent deterioration of dielectric strength and other physical properties thereof. Therefore, a compact cable having an impulse internal pressure higher than a voltage of a general cable may be achieved and shortening of the lifespan of the cable may be suppressed.

According to an embodiment of the present invention, each of the inner insulating layer 310 and the outer insulating layer 330 may be formed by cross-winding kraft paper made of kraft pulp and impregnating the kraft paper with insulating oil. Thus, the insulating layer 310 and the outer insulating layer 330 may have lower resistivity and a higher dielectric constant than those of the intermediate insulating layer 320. The kraft paper may be prepared by removing organic electrolytes from the kraft pulp and cleaning the kraft pulp with deionized water to obtain a high dielectric tangent and a high dielectric constant.

The intermediate insulating layer 320 may be formed by cross-winding semi-synthetic paper a plastic film in which kraft paper is stacked on a surface, a back surface, or both of them and then impregnating the semi-synthetic paper with insulating oil. Because the intermediate insulating layer 320 formed as described above includes the plastic film, the intermediate insulating layer 320 has high resistivity, a low dielectric constant, a high DC dielectric strength and a high impulse breakdown voltage as compared with the inner insulating layer 310 and the outer insulating layer 330. The entire insulating layer 300 may be made compact by concentrating a DC electric field on the intermediate insulating layer 320 which is robust to DC internal electric field strength due to the high resistivity thereof and concentrating an impulse electric field on the intermediate insulating layer 320 which is robust to impulse electric field due to low dielectric constant thereof. Accordingly, an outer diameter of the cable may be decreased.

In the semi-synthetic paper used to form the intermediate insulating layer 320, the plastic film expands due to heat generated during the operation of the cable and thus oil resistance increases to suppress movement of the insulating oil impregnated in the insulating layer 300 to the outer semi-conductive layer 400. Thus, oiling voids may be suppressed from occurring due to the movement of the insulating oil, thereby suppressing concentration of an electric field and dielectric breakdown due to the deoiling voids. Here, the plastic film may be formed of polyolefin resin such as polyethylene, polypropylene or polybutylene, fluorine resin such as tetrafluoroethylene-hexafluoro polypropylene copolymer, ethylene-tetrafluoroethylene copolymer, and preferably, polypropylene homopolymer resin having high heat resistance.

A thickness of the plastic film may be 40 to 70% of the total thickness of the semi-synthetic paper. When the thickness of the plastic film is less than 40% of the total thickness of the semi-synthetic paper, the outer diameter of the cable may increase due to insufficient resistivity of the intermediate insulating layer 320. In contrast, when the thickness of the plastic film is greater than 70% of the total thickness of the semi-synthetic paper, the semi-synthetic paper may be difficult to process, i.e., prepare, may be difficult to be impregnated with the insulating oil due to insufficient distribution paths of insulating oil, and may be expensive.

A thickness of the inner insulating layer 310 may be in a range of 1 to 10% of the total thickness of the insulating layer 300, a thickness of the outer insulating layer 330 may be in a range of 5 to 15% of the total thickness of the insulating layer 300, and a thickness of the intermediate insulating layer 320 may be greater than or equal to 75% of the total thickness of the insulating layer 300. Thus, the maximum impulse electric field value of the inner insulating layer 310 may be lower than that of the intermediate insulating layer 320. When the thickness of the inner insulating layer 310 is increased more than necessary, the maximum impulse electric field value of the intermediate insulating layer 310 becomes greater than a permissible maximum impulse electric field value. In order to alleviate this problem, the outer diameter of the cable should be increased. It is preferable that the thickness of the outer insulating layer 330 be sufficiently larger than that of the inner insulating layer 310, as will be described below.

In addition, in the present invention, the inner insulating layer 310 and the outer insulating layer 330 having low resistivity are provided to suppress a high DC electric field from being applied directly onto the conductor 100 and directly below the metal sheath layer 500. Furthermore, the thickness of the intermediate insulating layer 320 having high resistivity is designed to be 75% or more and thus the outer diameter of the cable may be reduced while maintaining sufficient dielectric strength.

As described above, the thicknesses of the inner insulating layer 310, the intermediate insulating layer 320, and the outer insulating layer 330 of the insulating layer 300 may be precisely controlled to minimize the outer diameter of the cable while achieving desired dielectric strength of the insulating layer 300. In addition, electric fields of direct current and an impulse applied to the insulating layer 300 may be designed to be most effective internal electric fields, and high electric fields of direct current and an impulse may be suppressed from being applied directly onto the conductor 100 and directly below the metal sheath layer 500 to apply a design means to increase dielectric strength of a cable connection member, which is vulnerable to an electric field, to a sufficient level.

Preferably, the thickness of the outer insulating layer 330 is greater than that of the inner insulating layer 310. For example, in the case of a 500 kV DC cable, the inner insulating layer 310 may have a thickness of 0.1 to 2.0 mm, the outer insulating layer 330 may have a thickness of 1.0 to 3.0 mm, and the intermediate insulating layer 320 may have a thickness of 15 to 25 mm.

Heat generated during a lead-joining work for connection of the cable according to the present invention may be supplied to the insulating layer 300 and thus the plastic film of the semi-synthetic paper of the intermediate insulating layer 320 may be melted by the heat. Thus, in order to protect the plastic film from the heat, the outer insulating layer 330 should be formed to a sufficient thickness and is preferably thicker than the inner insulating layer 310. The thickness of the outer insulating layer 330 is preferably 1 to 30 times that of the inner insulating layer 310.

In addition, the thickness of a sheet of semi-synthetic paper used to form the intermediate insulating layer 320 may be in a range of 70 to 200 μm, and the thickness of kraft paper used to form the inner and outer insulating layers 310 and 320 may be in a range of 50 to 150 μm. The thickness of the kraft paper used to form the inner and outer insulating layers 310 and 320 may be greater than that of the kraft paper of the semi-synthetic paper.

When the kraft paper used to form the inner and outer insulating layers 310 and 320 is extremely thin, mechanical damage may be caused due to insufficient strength of the kraft paper when the kraft paper is wound, and the number of cross-winding the kraft paper should be increased to form an insulating layer to a desired thickness, thereby reducing productivity of the cable. Furthermore, because total volume of gaps in the wound kraft paper, which serve as a main passage of the insulating oil, decreases, it may take a long time to impregnate the kraft paper with the insulating oil, and the amount of the insulating oil impregnated in the kraft paper may decrease, making it difficult to achieve desired dielectric strength.

The insulating oil impregnated in the insulating layer 300 is fixed without being circulated in a lengthwise direction of the cable, similar to a low-viscosity insulating oil used in existing OF cables, and thus, an insulating oil having relatively high viscosity is used. The insulating oil may be used to not only achieve desired dielectric strength of the insulating layer 300 but also to function as a lubricant to facilitate the movement of the insulating paper when the cable is bent.

The insulating oil is not particularly limited but a medium-viscosity insulating oil having a kinematic viscosity of to 500 centistokes (cSt) at 60° C. or a high-viscosity insulating oil having a kinematic viscosity of 500 centistokes (cSt) or more at 60° C. may be used. For example, at least one insulating oil selected from the group consisting of naphthenic insulating oil, polystyrene insulating oil, mineral oil, alkyl benzene or polybutene synthetic oil, heavy alkylate, and the like may be mixed and used.

A process of impregnating the insulating layer 300 with the insulating oil may be performed by cross-winding each of the kraft paper and the semi-synthetic paper a plurality of times to form the inner insulating layer 310, the intermediate insulating layer 320 and the outer insulating layer 330 to desired thicknesses, vacuum-drying these layers to remove residual moisture from the insulating layer 300, impregnating the insulating layer 300 with the insulating oil for a certain time by injecting into a tank the insulating oil heated to a high impregnation temperature, e.g., 100 to 120° C. under a high pressure environment, and gradually cooling the insulating oil.

The outer semi-conductive layer 400 suppresses a non-uniform electric field distribution between the insulating layer 300 and the metal sheath layer 500, alleviates an electric field distribution, and physically protects the insulating layer 300 from the metal sheath layer 500 which may have various shapes.

The outer semi-conductive layer 400 may be formed by cross-winding semi-conductive paper, such as carbon paper obtained by treating insulating paper with conductive carbon black, and may preferably include a lower layer formed by cross-winding the semi-conductive paper and an upper layer formed by gap-winding or overlap-winding the semi-conductive paper and metallized paper.

Here, the gap-winding refers to a method of cross-winding the semi-conductive paper to form gaps therein, and repeatedly cross-winding new semi-conductive paper or the like on the semi-conductive paper or the like to form gaps therein, such that the previous gaps are covered with the new semi-conductive paper or the like.

In addition, when the semi-conductive paper and the metallized paper are overlap-wound in the upper layer, the metallized paper and the semi-conductive paper may be alternately cross-wound such that certain portions thereof, e.g., 20 to 80% thereof, overlap each other.

Here, the metallized paper may have a structure in which a metal foil such as aluminum tape or aluminum foil is stacked on base paper such as kraft paper or carbon paper. The metal foil may include a plurality of perforations via which insulating oil may easily penetrate into semi-conductive paper, insulating paper, semi-synthetic paper, etc. below the metal foil. Thus, the semi-conductive paper of the lower layer may be brought into smooth electrical contact with the metal foil of the metallized paper through the semi-conductive paper of the upper layer. As a result, the outer semi-conductive layer 400 and the metal sheath layer 500 may be brought into smooth electrical contact with each other and thus a uniform electric field distribution may be formed between the insulating layer 300 and the metal sheath layer 500.

In addition, a woven copper-wire fabric (not shown) may be additionally provided between the outer semi-conductive layer 400 and the metal sheath layer 500. The woven copper-wire fabric has a structure in which 2 to 8 strands of copper wire are directly inserted into a nonwoven fabric. Through the copper wire, the semi-conductive layer 400 and the metal sheath layer 500 may be brought into smooth electrical contact with each other. Additionally, the semi-conductive paper, the metallized paper, and the like which are wound to form the outer semi-conductive layer 400 may be firmly bound to maintain the above structure without being loosened, and the metallized paper and the like may be prevented from being damaged (e.g., being torn) due to the movement of the metal sheath layer 500 when the cable thermally contracts and thus is bent.

The metal sheath layer 500 prevents the insulating oil from leaking to the outside from the inside of the cable, functions as a return path of fault current when a grounding or short-circuit occurs in the cable by grounding an end of the cable by maintaining a voltage, which is applied to the cable during transmission of direct current, between the conductor 100 and the metal sheath layer 500, thereby securing safety, protects the cable from external impacts, pressure, etc., and improves watertightness, flame retardancy, etc. of the cable.

The metal sheath layer 500 may be, for example, a lead sheath formed of pure lead or a lead alloy. As the metal sheath layer 500, the lead sheath may also function as a high-current conductor owing to relatively low electrical resistance thereof, and may additionally improve watertightness, mechanical strength, fatigue characteristics, etc. of the cable, when formed as a seamless type.

Furthermore, a corrosion inhibiting compound, e.g., blown asphalt, may be applied on a surface of the lead sheath to additionally improve corrosion resistance, watertightness, etc. of the cable and improve adhesion between the metal sheath layer 500 and the cable protection layer 600.

Figure 4:
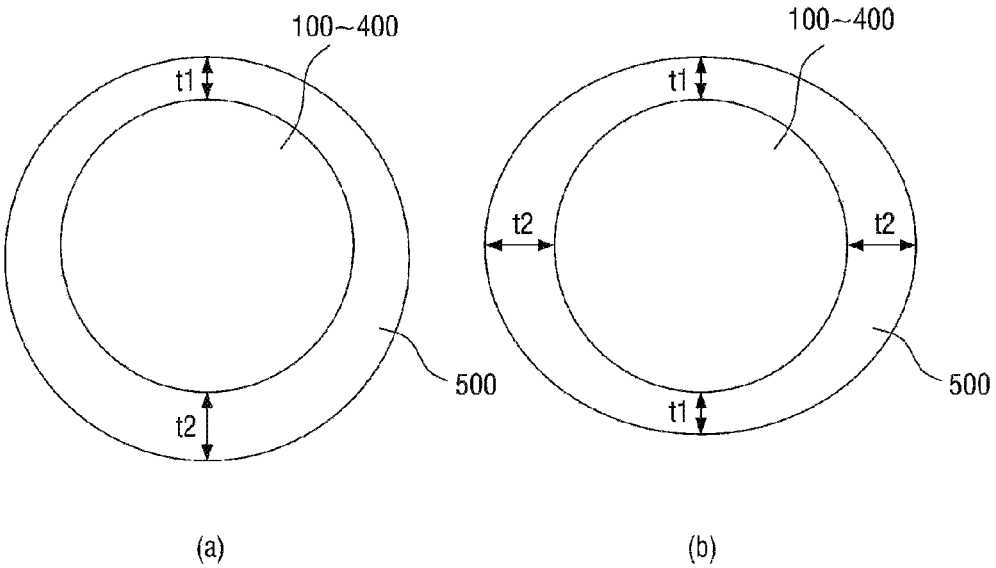
FIG. 4 is an enlarged view of a structure of a metal sheath layer of the power cable of FIG. 1.

FIG. 4 is an enlarged view of a structure of a metal sheath layer of the power cable of FIG. 1.

As illustrated in FIG. 4, a cross section of the metal sheath layer 500 may have irregular thicknesses. Specifically, as illustrated in FIG. 4(*a*), a certain cross section of the metal sheath layer 500 may have a minimum thickness t1 and a maximum thickness t2. Preferably, as illustrated in FIG. 4(*b*), an outer side of the metal sheath layer 500 is generally oval in shape, opposite and symmetrical upper and lower sides of the metal sheath layer 500 may have the minimum thickness t1 and opposite and symmetrical left and right sides thereof may have the maximum thickness t2. In FIGS. 4(*a*) and (*b*), the minimum thickness t1 may be 90% or less of the maximum thickness t2, and preferably, in a range of 50 to 90% of the maximum thickness t2.

When a power cable of the present invention is installed or operated in an extreme region in a low-temperature environment, the insulating oil impregnated in the inner semi-conductive layer 200, the insulating layer 300, the outer semi-conductive layer 400, etc. contracts and thus a plurality of deoiling voids containing no insulating oil occur in the insulating layer 300 and the like. In case that a certain cross section of the metal sheath layer 500 has irregular thicknesses as described above, when an external force is applied to the cable during the installation or operation thereof, a relatively thin portion of the metal sheath layer 500 may be easily deformed by the external force, thus changing an inner shape of the metal sheath layer 500 from a round shape to an oval shape. Accordingly, a cross-sectional area of the inside of the metal sheath layer 500 decreases and thus the deoiling voids occurring in the insulating layer 300 and the like may decrease.

Figure 5:
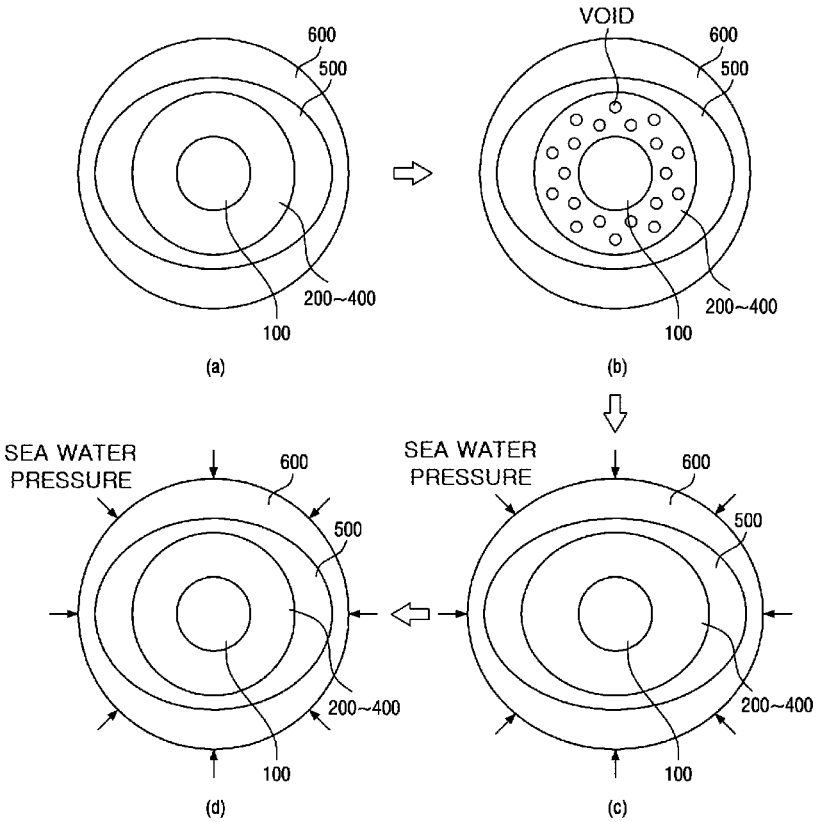
FIG. 5 is a schematic view of a process of deformation of a cross-sectional structure of the power cable of FIG. 1 when the power cable is installed underground or at the seabed.

FIG. 5 is a schematic view of a process of deformation of a cross-sectional structure of the power cable of FIG. 1 when the power cable is installed underground or at the seabed. For convenience of explanation of the concept, sizes of voids are exaggerated and an inner cross section of the metal sheath layer is exaggeratedly illustrated as having an oval shape.

In detail, when the power cable of the present invention having a cross section illustrated in FIG. 5(*a*) is installed underground or at the seabed as illustrated in FIG. 5(*b*), a hydraulic pressure may decrease, a negative pressure may be generated sometimes, and a plurality of deoiling voids containing no insulating layer may occur in the insulating layer 200 and the like (i.e., the layers 200 to 400), due to the contraction of the insulating oil impregnated in the inner semi-conductive layer 200, the insulating layer 300, the outer semi-conductive layer 400, etc. in a low-temperature environment under the ground or at the seabed. However, as illustrated in FIG. 5(*c*), a relatively thin portion of the metal sheath layer 500 is inwardly deformed by either an external force applied due to contraction of an inner sheath 610 on an outer side of the metal sheath layer 500 or a sea water pressure at the seabed until a pressure thereof becomes equal to the external force. Thus, an inner cross section of the metal sheath layer 500 is deformed into an oval shape and thus a cross-sectional area of the metal sheath layer 500 decreases. Accordingly, hydraulic pressures in the insulating layer 300, etc. (i.e., the layers 200 to 400) increase and the deoiling voids occurring therein decrease, thereby preventing deterioration of insulation performance. In addition, as illustrated in FIG. 5(*d*), when heat is generated by the conductor 100 due to the operation of the power cable, the insulating oil impregnated in the insulating layer 300, etc. (the layers 200 to 400) expands and thus the inner cross section of the metal sheath layer 500 returns to a round shape and the round shape is maintained by an external force greater than or equal to an external pressure generated by at least the inner sheath 610.

That is, because a power cable of the present invention includes a metal sheath layer having irregular thicknesses at a certain cross-section thereof, the power cable is capable of effectively reducing deoiling voids occurring in the insulating layer, etc. (the layers 200 to 400) due to the contraction of the insulating oil in a low-temperature environment and thus exhibits an excellent and unexpected effect of suppressing partial discharge, dielectric breakdown, and the like, caused by an electric field concentrated in the deoiling voids.

Referring to FIG. 4, the portion of the metal sheath layer 500 having the minimum thickness t1 is not easily deformed by external pressure and thus an effect of reducing the deoiling voids may be insufficient, when the minimum thickness t1 of a cross section of the metal sheath layer 500 is greater than 90% of the maximum thickness t2 thereof. In contrast, a whole cross section of the power cable cannot be maintained in a circular stable structure, when the minimum thickness t1 of the cross section of the metal sheath layer 500 is less than 50% of the maximum thickness t2.

The cable protection layer 600 may include, for example, a metal reinforcement layer 630 and an outer sheath 650, and may further include the inner sheath 610 and bedding layers 620 and 640 on and below the metal reinforcement layer 630. Here, the inner sheath 610 improves corrosion resistance, watertightness of the cable, and protects the cable from mechanical trauma, heat, fire, ultraviolet rays, insects or animals. The inner sheath 610 is not particularly limited but may be formed of polyethylene having excellent cold resistance, oil resistance, chemical resistance, etc., polyvinyl chloride having excellent chemical resistance, flame resistance, etc., or the like.

The metal reinforcing layer 630 protects the cable from mechanical stress, and may be formed of galvanized steel tape, stainless steel tape, or the like to prevent corrosion. A corrosion inhibiting compound may be applied to a surface of the galvanized steel tape. The bedding layers 620 and 640 on and below the metal reinforcement layer 630 may alleviate external impact or pressure, and may be formed, for example, using a nonwoven tape.

The metal reinforcement layer 630 may be provided directly on the metal sheath layer 500 or through the bedding layers 620 and 640. In this case, mechanical reliability of the cable may be improved because the metal sheath layer 500 is suppressed from expanding and being deformed due to expansion of the insulating oil in the metal reinforcement layer 630 at a high temperature, and at the same time, dielectric strength thereof may be improved because a high hydraulic pressure is applied to portions of the insulating layer 300 and the semi-conductive layers 200 and 400 included in the metal sheath layer 500.

The outer sheath 650 has substantially the same function and characteristics as the inner sheath 610. An outer sheath of a cable used in a submarine tunnel, a terrestrial tunnel section, etc. may be formed of polyvinyl chloride having excellent flame retardancy, because fire is a risk factor that greatly affects manpower or equipment safety. An outer sheath of a cable used in a pipe conduct section may be formed of polyethylene having excellent mechanical strength and cold resistance.

Although not shown, the inner sheath 610 may be omitted and the metal reinforcement layer 630 may be directly installed on the metal sheath layer 500, and a bedding layer may be provided, as needed, inside and outside the metal reinforcement layer 630. That is, a bedding layer, a metal reinforcement layer, a bedding layer, and an outer sheath may be sequentially provided on an outer side of the metal sheath layer. In this case, it is preferable in terms of fatigue characteristics of the metal sheath layer 500 because the metal reinforcement layer 630 allows deformation of the metal sheath layer 500 but suppresses a change of an outer circumferential length thereof, a hydraulic pressure of the cable insulating layer 300 in the metal sheath layer 500 may be increased when electric power is supplied to the cable, a decrease in the hydraulic pressure, caused by contraction of the insulating oil due to a decrease in temperature of the cable when the supply of the electric current is stopped, may be compensated, and the insulating oil may be replenished by moving it from a part having a high hydraulic pressure to a part, e.g., the inner semi-conductive layer 200, in which a hydraulic pressure sharply decreases due to the difference between the hydraulic pressures.

In addition, when the cable is a submarine cable, the cable protection layer 600 may further include a wire sheath 660, an outer serving layer 670 formed of polypropylene yarn or the like, etc. The wire sheath 660 and the outer serving layer 670 may additionally protect the cable from sea currents, reefs, etc. at the seabed.

While the present invention has been described above with respect to exemplary embodiments thereof, it would be understood by those of ordinary skilled in the art that various changes and modifications may be made without departing from the technical conception and scope of the present invention defined in the following claims. Thus, it is clear that all modifications are included in the technical scope of the present invention as long as they include the components as claimed in the claims of the present invention.

The invention claimed is:

1. A power cable comprising:

a conductor;

an inner semi-conductive layer covering the conductor;

an insulating layer covering the inner semi-conductive layer and impregnated with insulating oil;

an outer semi-conductive layer covering the insulating layer;

a metal sheath layer covering the outer semi-conductive layer; and a cable protection layer covering the metal sheath layer, wherein a minimum thickness t1 of a certain cross section of the metal sheath layer is less than or equal to 90% of a maximum thickness t2 thereof, such that deoiling voids within the insulating layer are reduced.

2. The power cable of claim 1, wherein the minimum thickness t1 of the certain cross section of the metal sheath layer is in a range of 50 to 90% of the maximum thickness t2.

3. The power cable of claim 1, wherein an outer side of the metal sheath layer is generally oval in shape, wherein opposite and symmetrical upper and lower portions of the certain cross section thereof have the minimum thickness t1, and wherein opposite and symmetrical left and right portions of the certain cross section have the maximum thickness t2.

4. The power cable of claim 1, wherein the metal sheath layer comprises a lead sheath formed of pure lead or a lead alloy.

5. The power cable of claim 1, wherein the insulating oil comprises a high-viscosity insulating oil having a kinematic viscosity of 500 centistokes (Cst) or more at 60° C.

6. The power cable of claim 1, wherein the insulating oil is a medium-viscosity insulating oil having a kinematic viscosity of 5 to 500 centistokes (Cst) at 60° C.

7. The power cable of claim 1, wherein the cable protection layer comprises another bedding layer, a metal reinforcement layer, a bedding layer, and an outer sheath which are stacked sequentially on an outer side of the metal sheath layer.

8. The power cable of claim 1, wherein the insulating layer comprises an inner insulating layer, an intermediate insulating layer, and an outer insulating layer, wherein the inner insulating layer and the outer insulating layer are each formed of kraft paper impregnated with the insulating oil, wherein the intermediate insulating layer is formed of semi-synthetic paper impregnated with the insulating oil, wherein the semi-synthetic paper comprises a plastic film and kraft paper stacked on at least one surface of the plastic film, wherein a thickness of the inner insulating layer is in a range of 1 to 10%, a thickness of the intermediate insulating layer is 75% or more, and a thickness of the outer insulating layer is in a range of 5 to 15%, based on a total thickness of the insulating layer, and wherein resistivities of the inner insulating layer and the outer insulating layer are less than resistivity of the intermediate insulating layer.

9. The power cable of claim 8, wherein the thickness of the outer insulating layer is greater than the thickness of the inner insulating layer.

10. The power cable of claim 1, wherein the cable protection layer comprises an inner sheath, a bedding layer, a metal reinforcement layer, and an outer sheath.

11. The power cable of claim 10, wherein the cable protection layer further comprises a wire sheath and an outer sheath layer.

* * * * *